US009352577B2

(12) United States Patent
Tanaka et al.

(10) Patent No.: US 9,352,577 B2
(45) Date of Patent: May 31, 2016

(54) INK TANK AND PRINTER

(71) Applicant: SEIKO EPSON CORPORATION, Tokyo (JP)

(72) Inventors: Yoshiyuki Tanaka, Matsumoto (JP); Hiroaki Sakai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/807,161

(22) Filed: Jul. 23, 2015

(65) Prior Publication Data

US 2016/0023468 A1 Jan. 28, 2016

(30) Foreign Application Priority Data

Jul. 25, 2014 (JP) ..... 2014-151567
Mar. 18, 2015 (JP) ..... 2015-054406

(51) Int. Cl.
*B41J 2/175* (2006.01)

(52) U.S. Cl.
CPC ..... *B41J 2/17523* (2013.01)

(58) Field of Classification Search
CPC .... B41J 2/175; B41J 2/17506; B41J 2/17523; B41J 2/17553
USPC ..... 347/85, 86
See application file for complete search history.

(56) References Cited

U.S. PATENT DOCUMENTS 6,048,055 A * 4/2000 Hakkaku ..... B41J 2/175 347/85
6,238,042 B1 * 5/2001 Kobayashi ..... B41J 2/17506 347/86
6,247,804 B1 * 6/2001 Watanabe ..... B41J 2/01 347/101
6,474,802 B1 * 11/2002 Lui ..... B41J 2/17513 347/86
6,648,460 B2 * 11/2003 Gonzales ..... B41J 2/17513 347/86
6,682,184 B2 * 1/2004 Anderson ..... B41J 2/17509 347/86
7,258,434 B2 * 8/2007 Smith ..... B41J 2/17553 347/84
7,614,710 B2 * 11/2009 Haines ..... B41J 2/17513 347/6

FOREIGN PATENT DOCUMENTS

JP 2013-119239 6/2013

* cited by examiner

*Primary Examiner* — Anh T. N. Vo
(74) *Attorney, Agent, or Firm* — Workman Nydegger

(57) ABSTRACT

An ink tank includes: a reservoir that stores ink; a supply port that supplies ink stored in the reservoir to a printer; a supply port sealing member that seals the supply port; an air port that communicates between an inside of the reservoir and an atmospheric space above an upper side of a liquid surface of the ink; and an air port sealing member which a needle tube is capable of inserting and pulling out of, and which seals the air port in a state where the needle tube is not inserted.

11 Claims, 5 Drawing Sheets

INK TANK AND PRINTER

CROSS REFERENCES TO RELATED APPLICATIONS

The entire disclosure of Japanese Patent Application No. 2015-054406, filed Mar. 18, 2015 is incorporated by reference herein.

The entire disclosure of Japanese Patent Application No. 2014-151567, filed Jul. 25, 2014 is incorporated by reference herein.

BACKGROUND

1. Technical Field

The present invention relates to an ink tank and a printer.

2. Related Art

In recent years, for the purpose of reduction of running cost, an ink jet printer capable of mounting an ink tank of a large capacity has been developed. The ink tank of the large capacity is not mounted on a carriage reciprocating with a print head mounted on and ink is supplied from the ink tank to the print head by using a flexible tube. The ink tank has a portable sealing structure and it is necessary to work to communicate between the inside of the ink tank and an atmospheric space by peeling off a seal or removing a cap at the time of replacement. It is possible to push ink toward the print head at atmospheric pressure by this work.

JP-A-2013-119239 is an example of the related art.

However, there is a problem that hands are likely to be dirty with ink when the work for communicating between the inside of the ink tank and the atmospheric space is performed or when the ink tank after use is removed from the printer.

SUMMARY

One of advantages of some aspects of the invention is to provide an ink tank of which replacement work is easy and a printer in which replacement of the ink tank is easy.

According to an aspect of the invention, there is provided an ink tank including: a reservoir that stores ink; a supply port that supplies ink stored in the reservoir to a printer; a supply port sealing member that seals the supply port; an air port that communicates between an inside of the reservoir and an atmospheric space above an upper side of a liquid surface of the ink; and an air port sealing member which a needle tube is capable of inserting and pulling out of, and which seals the air port in a state where the needle tube is not inserted.

According to another aspect of the invention, there is provided a printer including: a receiving section that receives supply of ink from a supply port of an ink tank; a needle tube that is capable of penetrating an air port sealing member sealing an air port of the ink tank above an upper side of a liquid surface of the ink; and a needle support section that supports the needle tube such that the needle tube is capable of inserting and pulling out of the air port sealing member.

According to these inventions, communication between the inside of the ink tank and an atmospheric space can be performed or an air port can be sealed by inserting and pulling out a needle tube provided in the printer. Thus, replacement work of the ink tank is easy. Specifically, for example, since it is not necessary to directly operate a sealing member of the air port, hands are unlikely to be dirty with ink when work is performed for communicating between the inside of the ink tank and the atmospheric space or when the ink tank after use is removed from the printer. Moreover, "upper side of a liquid surface of ink" means a region which becomes the upper side of the liquid surface of ink in a state where the ink tank is appropriately mounted on the printer.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1A:
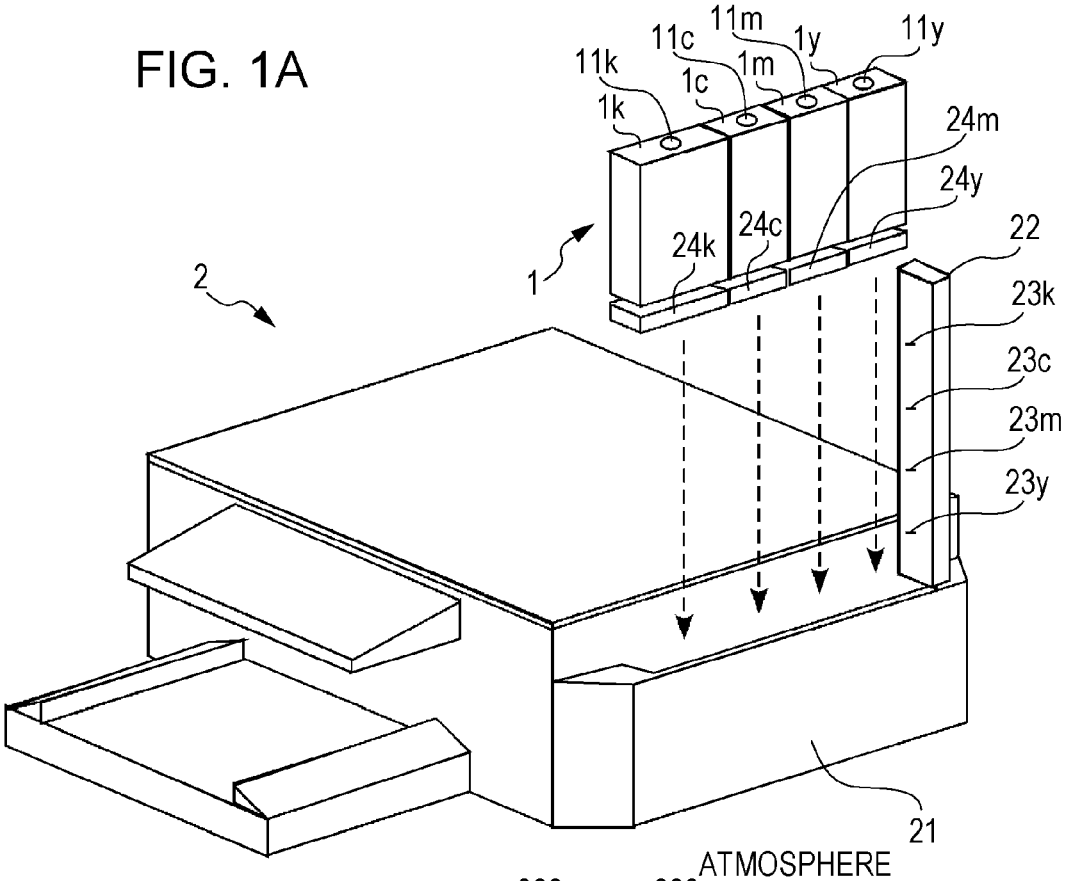
FIG. 1A is an external perspective view of a printer in a state where an ink tank is taken out and FIG. 1B is a schematic cross-sectional view of the ink tank included in the printer.

Hereinafter, embodiments of the invention will be described with reference to the drawings in the following order. In addition, the same reference numerals are given to corresponding configuration elements in each view and overlapping description will be omitted.

First Embodiment

1. Overview

Figure 1B:
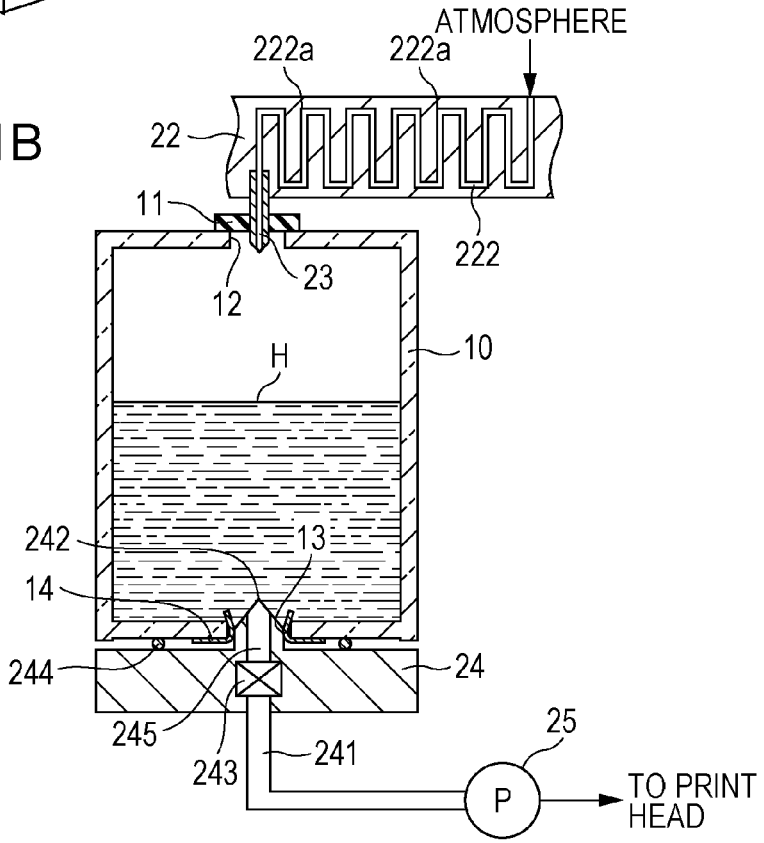

As one embodiment of the invention, a printer 2 and an ink tank 1 are illustrated in FIGS. 1A and 1B. The printer 2 includes an ink jet type print mechanism and is capable of mounting the ink tank 1 of a large capacity. Thus, the printer 2 is provided with an accommodating section 21 for accommodating the ink tank 1. The accommodating section 21 is provided with a lid 22 covering the accommodated ink tank 1. A needle tube 23 is provided in an inside of the lid 22. If the lid 22 is closed, the needle tube 23 is inserted into an air port sealing member 11 of the ink tank 1 and an internal space of the ink tank 1 communicates with an atmospheric space. In order to make a state of the ink tank 1 usable, it is necessary to communicate between the internal space of the ink tank 1 and the atmospheric space, and according to the embodiment, a user can communicate between the internal space of the ink tank 1 and the atmospheric space without directly operating the air port sealing member 11.

2. Configuration of Ink Tank

As illustrated in FIG. 1B, a hollow reservoir 10 is formed in the ink tank 1. Ink is accommodated in the reservoir 10 of the ink tank 1. It is preferable that the reservoir 10 is configured of a transparent or translucent material to easily and visually determine a remaining amount of ink. In FIG. 1A, a form, in which an ink tank 1*k* for black ink, an ink tank 1*c* for cyan ink, an ink tank 1*m* for magenta ink, and an ink tank 1*y* for yellow ink are individually replaceable, is illustrated. The ink tank 1 may have a form including inner walls that divide the reservoir for each type of ink.

Figure 2A:
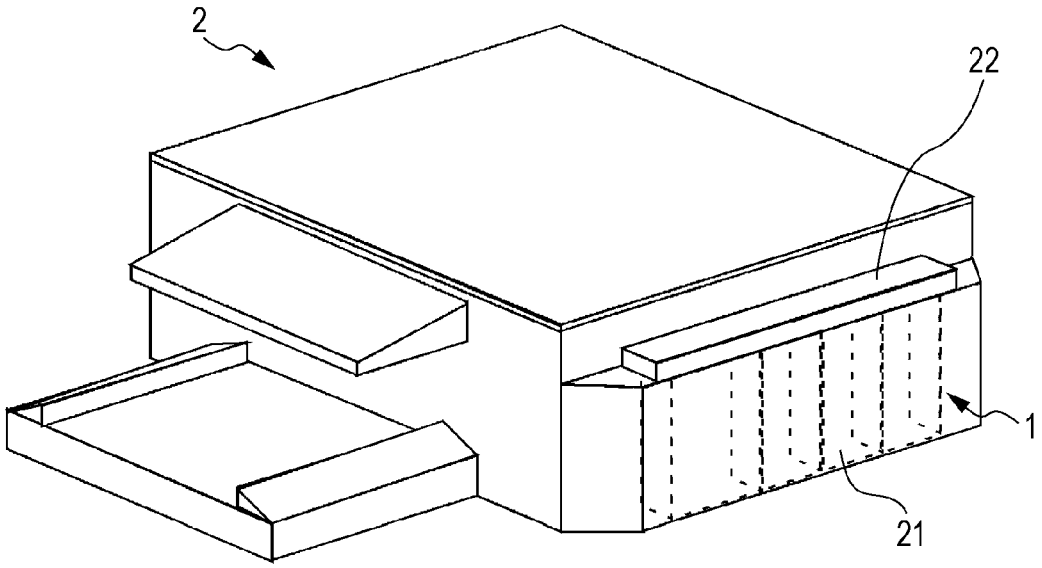
FIG. 2A is an external perspective view of the printer and FIG. 2B is a schematic cross-sectional view of the ink tank.
Figure 2B:
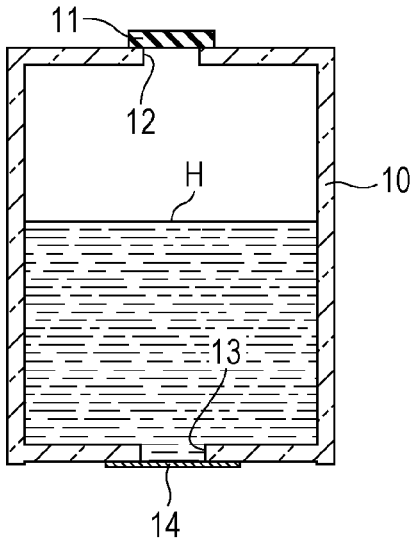

A supply port 13 that is a through hole is formed in a portion that becomes a bottom in a state where the ink tank 1 of FIG. 2B is mounted on the printer 2. The supply port 13 is sealed with a supply port sealing member 14 in a state where the ink tank 1 is not used. For example, the supply port sealing member 14 is configured of a metal film such as aluminum, a plastic film, or a multilayer film of metal and paper. The supply port sealing member 14 may be protected by a removable cap to prevent the supply port sealing member 14 from being damaged.

An air port 12 that is a through hole is formed in a portion that is an upper side of a liquid surface H of ink in a state where the ink tank 1 of FIG. 2B is mounted on the printer 2. The air port 12 is sealed with the air port sealing member 11 in a state where the ink tank 1 is not used. As illustrated in FIG. 1B, the needle tube 23 can be inserted into the air port sealing member 11 and as illustrated in FIG. 2B, the air port sealing member 11 seals the air port 12 even in a state where the needle tube 23 is pulled out after insertion. For example, such an air port sealing member 11 is configured of an elastic material such as natural rubber and silicon elastomer.

3. Configuration of Printer

FIGS. 1A and 2A illustrate the printer 2 in which an entirety of the ink tank 1 accommodated in the accommodating section 21 is covered by the lid 22 and the accommodating section 21 when closing the lid 22. The accommodating section 21 may be provided in any portion if mounting and demounting of the ink tank 1 is easily performed and may have any form if the accommodating section 21 has a form capable of holding the ink tank 1.

As illustrated in FIGS. 1A and 1B, the printer 2 is provided with a connector 24 mounted on the ink tank 1. The connector 24 has a structure capable of mounting and dismounting with respect to the ink tank 1 and also to the accommodating section 21. For example, the connector 24 is mounted on the ink tank 1 by snap-fit or screw. The connector 24 is accommodated below the accommodating section 21 in a state of being mounted on the ink tank 1. If the ink tank 1 has a configuration capable of replacing for each type of ink, the connector 24 is provided independently for each ink tank.

A protrusion 242 piercing through the supply port sealing member 14 is formed on the connector 24. A seal ring 244 for inwardly collecting ink leaked from the supply port sealing member 14 which is broken through by the protrusion 242 is provided around the protrusion 242. A flow passage 245 for guiding ink from a tip end of the protrusion 242 to a valve 243 is formed in an inside of the connector 24. The valve 243 has a structure in which the value is closed if a conduit 241 for guiding ink to a pump 25 that feeds ink to a print head (not illustrated) is inserted into the connector 24 and if the conduit 241 is pulled out from the connector 24. In a case of a configuration in which a plurality types of ink are separately stored in one ink tank 1, a plurality of supply ports 13 and supply port sealing members 14 are needed for one ink tank 1. In this case, a plurality of protrusions piercing through the plurality of supply port sealing members 14 simultaneously may be provided in one connector 24.

The lid 22 of the accommodating section 21 has a form in which a concave section of the accommodating section 21 is closed in a state where the lid 22 is closed and the concave section of the accommodating section 21 is released in a state where the lid 22 is opened. The lid 22 of the accommodating section 21 is connected to the accommodating section 21 to be pivotable.

The needle tube 23 that is a thin tubular needle made of stainless steel, aluminum alloy, and the like is provided inside (side opposite to the accommodating section) of the lid 22. Moreover, a cross sectional shape of the needle tube 23 is not limited to O-shape, may be formed by connecting the inside and the outside such as C-shape, and also may have a polygonal shape rather than a circle. The needle tube 23 is fixed to the lid 22 in a position in which the needle tube 23 pierces through the air port sealing member 11 of the ink tank 1 in a state where the lid 22 is closed. That is, the needle tube 23 is positioned with respect to the air port sealing member 11 by the lid 22. The printer 2 illustrated in FIG. 1A is provided with a needle tube 23*k* corresponding to an air port sealing member 11*k* of the ink tank 1*k*, a needle tube 23*c* corresponding to an air port sealing member 11*c* of the ink tank 1*c*, a needle tube 23*m* corresponding to an air port sealing member 11*m* of the ink tank 1*m*, and a needle tube 23*y* corresponding to an air port sealing member 11*y* of the ink tank 1*y*. The needle tube 23 has a length penetrating the air port sealing member 11. Furthermore, the needle tube 23 has a thin outer diameter to an extent that the through hole formed in the air port sealing member 11 by the needle tube 23 is closed after the needle tube 23 is pulled out. Furthermore, the needle tube 23 has an inner diameter in which a flow passage resistance is increased with respect to ink to an extent that air sufficiently flows and ink is unlikely to reverse flow.

A meandering passage 222 is formed in the inside of the lid 22 as an atmosphere passage. The meandering passage 222 has a function for preventing ink flowing back from the ink tank 1 from flowing out and preventing ink of the ink tank 1 from evaporating when the printer 2 is moved and the like. Thus, the meandering passage 222 has a plurality of bending sections 222*a* and is thin to an extent that the flow passage resistance is sufficiently large with respect to ink. One end of the meandering passage 222 passes through the needle tube 23 and the other end of the meandering passage 222 is opened to the atmospheric space.

The conduit 241 is provided below the accommodating section 21. One end of the conduit 241 is connected to the valve 243 of the connector 24. The other end of the conduit 241 is connected to the pump 25. The pump 25 supplies ink from the ink tank 1 through the connector 24 and the conduit 241. The pump 25 receives supply of ink to the print head (not illustrated). The print head has a mechanism for discharging ink in a known ink jet type.

4. Operation

The ink tank 1 is provided in a state where the reservoir 10 is filled with ink. As illustrated in FIG. 1B, the user mounts the connector 24 on the ink tank 1 when using the ink tank 1. When the connector 24 is mounted on the ink tank 1, the protrusion 242 of the connector 24 pierces through the supply port sealing member 14 and the flow passage 245 of the connector 24 communicates with the reservoir 10 of the ink tank 1. In this case, portions between a periphery of the supply port of the ink tank 1 and a periphery of the protrusion 242 of the connector 24 come into close contact with each other. Furthermore, the valve 243 is closed in a state where the connector 24 is not mounted on the conduit 241 of the printer 2. Furthermore, when the connector 24 is mounted on the ink tank 1, the air port sealing member 11 of the ink tank 1 is closed. That is, the reservoir 10 is in a closed state yet in a state where the ink tank 1 on which the connector 24 is mounted is not mounted on the printer 2. Thus, when the user mounts the connector 24 on the ink tank 1, hands are unlikely to be dirty with ink.

When the ink tank 1 on which the connector 24 is mounted is inserted into the accommodating section 21, the conduit 241 is inserted into the valve 243 of the connector 24 and then the valve 243 is opened. In a state where the lid 22 is not closed, since the reservoir 10 of the ink tank 1 is not open to the atmospheric space, ink does not flow out from the supply port 13 of the ink tank 1 even if the valve 243 is opened.

When the ink tank 1 is inserted into the accommodating section 21 and the lid 22 is closed, the needle tube 23 supported on the lid 22 penetrates the air port sealing member 11 by piercing through the air port sealing member 11. If the needle tube 23 penetrates the air port sealing member 11, the reservoir 10 of the ink tank 1 communicates with the atmospheric space through the needle tube 23 and the meandering passage 222. As a result, ink of the reservoir 10 flows out from the supply port 13 by an atmospheric pressure introduced by the meandering passage 222 and the needle tube 23. Moreover, the ink tank 1 and the connector 24 are pressed down by closing the lid 22. As a result, the conduit 241 is inserted into the valve 243 and the valve 243 may be opened.

If the pump 25 is driven, a downstream side of ink becomes a negative pressure with respect to the atmospheric pressure by the pump 25 on an upstream side of the pump 25. Thus, ink stored in the reservoir 10 is sucked from the supply port 13 into the pump 25 as a receiving section and is pushed out to the print head. When the print head is driven, ink is fixed onto a print medium by being discharged from the print head.

If the lid 22 of the accommodating section 21 in which the ink tank 1 is accommodated is opened, the needle tube 23 supported on the lid 22 is pulled out from the air port sealing member 11. As a result, since the air port sealing member 11 is closed, flow out of ink from the supply port 13 is stopped. When the ink tank 1 is taken out from the accommodating section 21, the connector 24 is maintained in a state of being connected to the ink tank 1 without departing from the ink tank 1. Thus, the conduit 241 is removed from the valve 243 and the valve 243 is closed. Such an operation is achieved by appropriately setting a bonding force by snap-fit and screw between the ink tank 1 and the connector 24, and the like. Moreover, if the connector 24 is mounted on the ink tank 1 removed from the printer 2, it is also possible to store the ink tank 1 without degrading or leaking residual ink.

According to the embodiment described above, the air port sealing member 11 closing the air port 12 is provided in the ink tank 1 in a state where the needle tube 23 can be inserted and pulled out, and the needle tube 23 is not inserted. Thus, it is possible to replace the ink tank 1 without directly operating the air port sealing member 11. Furthermore, since the needle tube 23 is supported by the lid 22 of the printer 2, it is possible to replace the ink tank 1 without directly operating the needle tube 23. Thus, the user can prevent the hands from being dirty with ink when performing replacement work of the ink tank 1.

Then, since a needle support section supporting the needle tube 23 is the lid 22 of the accommodating section 21 in which the ink tank 1 accommodated, work for the purpose only for having the needle tube 23 piercing through the air port sealing member 11 is not necessary. That is, replacement work of the ink tank 1 is easily performed.

Furthermore, the meandering passage 222 for opening the inside of the ink tank 1 to the atmospheric pressure is formed in the lid 22 of the printer 2. Thus, it is possible to lengthen the meandering passage 222 and it is possible to prevent leakage of ink from the meandering passage 222 when the printer 2 is moved. Furthermore, since the plurality of bending sections 222*a* are formed in the meandering passage 222, it is possible to further reliably prevent leakage of ink.

Furthermore, since the ink tank 1 has a simple structure, it is possible to reduce the cost of the ink tank 1.

5. Other Embodiments

The technical scope of the invention is not limited to the embodiment described above and it is needless to say that various changes and modifications may be made within the scope not departing from the gist of the invention.

For example, if printing is performed in a state where the needle tube does not pierce through the air port sealing member, since the print head is driven in a state where ink is not supplied to the print head, it causes a failure. Thus, a sensor detecting whether or not the lid of the accommodating section also serving as the needle support section is appropriately closed may be provided. It is possible to detect whether or not the needle tube pierces through the air port sealing member and then the ink tank is in a state of being usable by providing such a sensor. Furthermore, the air port of the ink tank may be formed at a portion that is the upper side of the liquid surface of ink of a side wall of the ink tank. In addition, the supply port sealing member may have a configuration such that the needle tube for deriving ink from the ink tank can be inserted and pulled out, and the supply port is closed in a state where the needle tube is not inserted. Specifically, the configurations of the supply port sealing member and the air port sealing member may be the same as each other.

In addition, the ink tank may be partitioned to separate ink from air. Specifically, ink may be housed in an aluminum pack.

Furthermore, the meandering passage may be provided on the ink tank side or the connector may be formed integrally with the ink tank even though the cost of the ink tank is increased.

In addition, the lid of the accommodating section may have a configuration capable of mounting and demounting with respect to a printer body. In addition, the lid of the accommodating section may be independently provided for each ink tank. For example, as illustrated in FIG. 1A, the plurality of ink tanks are mounted, one lid may be independently provided for each ink tank. In addition, if the accommodating section is configured such that the supply port of the ink tank is positioned at a position sufficiently higher than the print head, it is possible to omit the pump for supplying ink to the print head by sucking ink.

The meandering passage may have a configuration such that one end portion is opened to the atmosphere and forms one common opening section, and the other end portion can communicate with each air port of the plurality of ink tanks. The meandering passage may have a configuration such that independent opening sections that correspond to the air ports of the plurality of ink tanks and are opened to the atmosphere are respectively formed and the opening sections are individually provided.

Second Embodiment

Figure 3A:
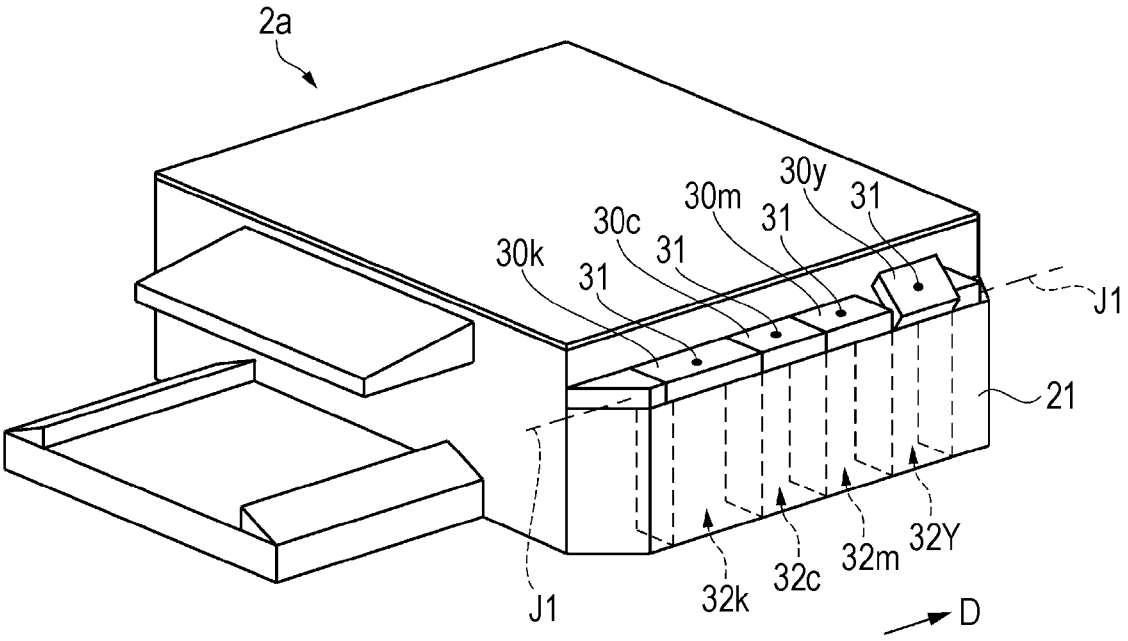
FIG. 3A is an external perspective view of a printer in a second embodiment and FIG. 3B is a schematic cross-sectional view of an ink tank included in the printer.

In the first embodiment, the printer 2 in which the meandering passage 222 is provided in the lid 22 is described, but in the second embodiment, a printer in which a meandering passage is provided in an ink tank is described. FIG. 3A is an external perspective view of a printer 2*a* in the embodiment.

As illustrated in FIG. 3A, a accommodating section 21 includes a ink tank 32*k* for black ink, a ink tank 32*c* for cyan ink, a ink tank 32*m* for magenta ink, a ink tank 32*y* for yellow ink in a row in a first direction D illustrated by an arrow.

Lids 30*k*, 30*c*, 30*m* and 30*y* have a pivot shaft J1 illustrated by a broken line of which a direction of the shaft is a first direction D and is connected to the accommodating section 21 to be pivotable. The lids 30*k*, 30*c*, 30*m* and 30*y* correspond to the ink tanks 32*k*, 32*c*, 32*m*, and 32*y*, and are provided to be pivotable individually.

The lids 30*k*, 30*c*, 30*m* and 30*y* cover upper portions of the ink tanks 32*k*, 32*c*, 32*m*, and 32*y* in a state of being closed, and the ink tanks 32*k*, 32*c*, 32*m*, and 32*y* are exposed in a state of being opened.

Figure 3B:
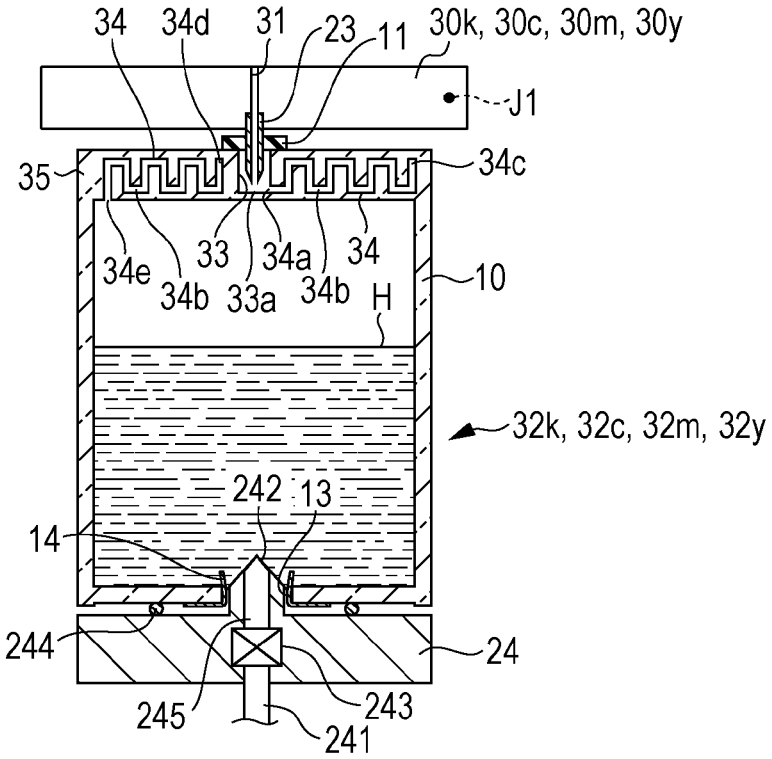

FIG. 3B is a schematic cross-sectional view of the ink tank 32*k* provided in the printer 2*a* of FIG. 3A. As described in the first embodiment, the ink tank 32*k* is accommodated in the accommodating section 21 in a state where a protrusion 242 formed in a connector 24 pierces through a supply port sealing member 14 provided in the supply port 13.

A needle tube 23 is provided in an inside of the lid 30*k* of FIG. 3B and an atmosphere port 31 communicating with the needle tube 23 is formed in the outside of lid 30*k*.

An air port 33 is formed in a center position in an upper wall section 35 of the reservoir 10. The air port 33 has a concave shape in which the lid 30*k* side is opened and a side opposite to the lid 30*k* is closed by a bottom wall 33*a*. An upper portion of the air port 33 is sealed by an air port sealing member 11. As illustrated in FIG. 3B, the needle tube 23 penetrates the air port sealing member 11 in a state where the lid 30*k* is closed.

A meandering passage 34 is formed in the upper wall section 35 as an atmosphere passage. A plurality of bending sections 34*b* are formed in the meandering passage 34. An end portion 34*c* and an end portion 34*d* of the meandering passage 34 communicate with each other by a meandering passage (not illustrated) through a front side or a rear side in a vertical direction in the view more than a cross section position illustrated in FIG. 3B.

An opening section 34*a* that is one end portion of the meandering passage 34 is formed on the bottom wall 33*a* side of the air port 33 and an opening section 34*e* that is the other end portion of the meandering passage 34 is formed in a lower portion of the upper wall section 35 on a left side in the view. The air port 33 and an internal space formed by the reservoir 10 communicate with each other through the meandering passage 34 by such a configuration.

The meandering passage 34 has a function for preventing ink flowing back from the ink tank 32*k* from flowing out and preventing ink of the ink tank 32*k* from evaporating when the printer 2*a* is moved and the like.

If the lid 30*k* is closed, the needle tube 23 penetrates the air port sealing member 11 of the ink tank 32*k* and the internal space formed by the reservoir 10 communicates with the atmospheric space through the air port 33 and the meandering passage 34.

A user can communicate between the internal space of the ink tank 32*k* and the atmospheric space by closing the lid 30*k* without directly operating the air port sealing member 11, and can make the ink tank 32*k* be a usable state. Configurations of the ink tanks 32*c*, 32*m*, and 32*y* are the same as the configuration of the ink tank 32*k*.

As described above, the ink tanks 32*k*, 32*c*, 32*m*, and 32*y* described in the embodiment include the meandering passage 34 as the atmosphere passage having the plurality of bending sections 34*b*, and the air port 33 communicates with the reservoir 10 through the meandering passage 34.

The meandering passage 34 for releasing the inside of the ink tanks 32*k*, 32*c*, 32*m*, and 32*y* to the atmospheric pressure is formed in the upper wall section 35 of the ink tanks 32*k*, 32*c*, 32*m*, and 32*y*. Thus, it is possible to lengthen the meandering passage 34 and it is possible to prevent leakage of ink from the meandering passage 34 when the printer 2*a* is moved. Furthermore, since the plurality of bending sections 34*b* are formed in the meandering passage 34, it is possible to further reliably prevent leakage of ink.

The meandering passage 34 may be formed on a wall portion forming the reservoir 10 lower than the upper wall section 35. In addition, the ink tanks 32*k*, 32*c*, 32*m*, and 32*y* provided with the meandering passage 34 is included and the lid 22 in which the meandering passage 222 of FIG. 1B described in the first embodiment is provided may be included.

In addition, the accommodating section 21 accommodates the ink tanks 32*k*, 32*c*, 32*m*, and 32*y* in a row in the first direction D and the lids 30*k*, 30*c*, 30*m* and 30*y* are included to be pivotable with respect to the accommodating section 21.

Positioning of the needle tube 23 is performed by such a configuration in a state where the lids 30*k*, 30*c*, 30*m* and 30*y* are closed. Thus, when the user pivots and closes the lids 30*k*, 30*c*, 30*m* and 30*y*, the needle tube 23 can reliably pass through the air port sealing member 11.

In addition, the meandering passages 34 are included individually corresponding to the ink tanks 32*k*, 32*c*, 32*m*, and 32*y*. Thus, even if ink enters the meandering passage 34 provided one ink tank when the printer 2*a* is moved, it is possible to prevent ink from entering the meandering passage 34 provided in another ink tank.

In addition, the lids 30*k*, 30*c*, 30*m* and 30*y* correspond to the ink tanks 32*k*, 32*c*, 32*m*, and 32*y* respectively and are individually included. Thus, the needle tube 23 is inserted and pulled out of the air port sealing member 11 alone of the ink tank of a replacement object and inserting and pulling out of the needle tube 23 is not necessary with respect to the air port sealing member 11 of the ink tank other than the replacement object. Therefore, the deterioration of the air port sealing member 11 of the ink tank other than the replacement object can be suppressed.

Other configurations of the ink tanks 32*k*, 32*c*, 32*m*, and 32*y* of the embodiment and other configurations of the printer 2*a* are the same as the configurations of the ink tanks 1*k*, 1*c*, 1*m*, and 1*y*, and the configurations of the printer 2 described in the first embodiment.

Figure 4:
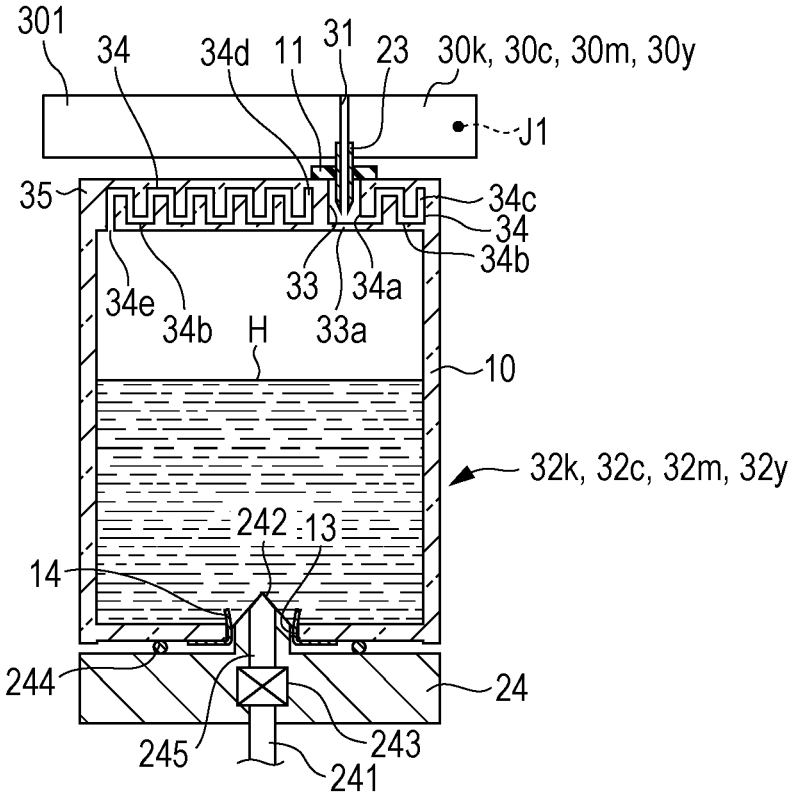
FIG. 4 is a schematic cross-sectional view of an ink tank included in a printer in another embodiment.

As illustrated in FIG. 4, the air port 33 sealed by the air port sealing member 11 may be provided in a position on the pivot shaft J1 side from the center position of the lids 30*k*, 30*c*, 30*m* and 30*y* in a direction (right and left direction in the view) intersecting the first direction D in which the ink tanks 32*k*, 32*c*, 32*m*, and 32*y* are arranged in a row.

A force is reduced which is required for the user to pivot the lids 30*k*, 30*c*, 30*m* and 30*y* in a closing direction and to make the needle tube 23 penetrate the air port sealing member 11 while pressing an upper end portion 301 in a position opposite to the pivot shaft J1 in a direction intersecting the first direction D by hand.

In addition, the pivot shaft is provided an outside of the printer 2*a*, but may be provided inside the printer 2*a*.

Figure 5:
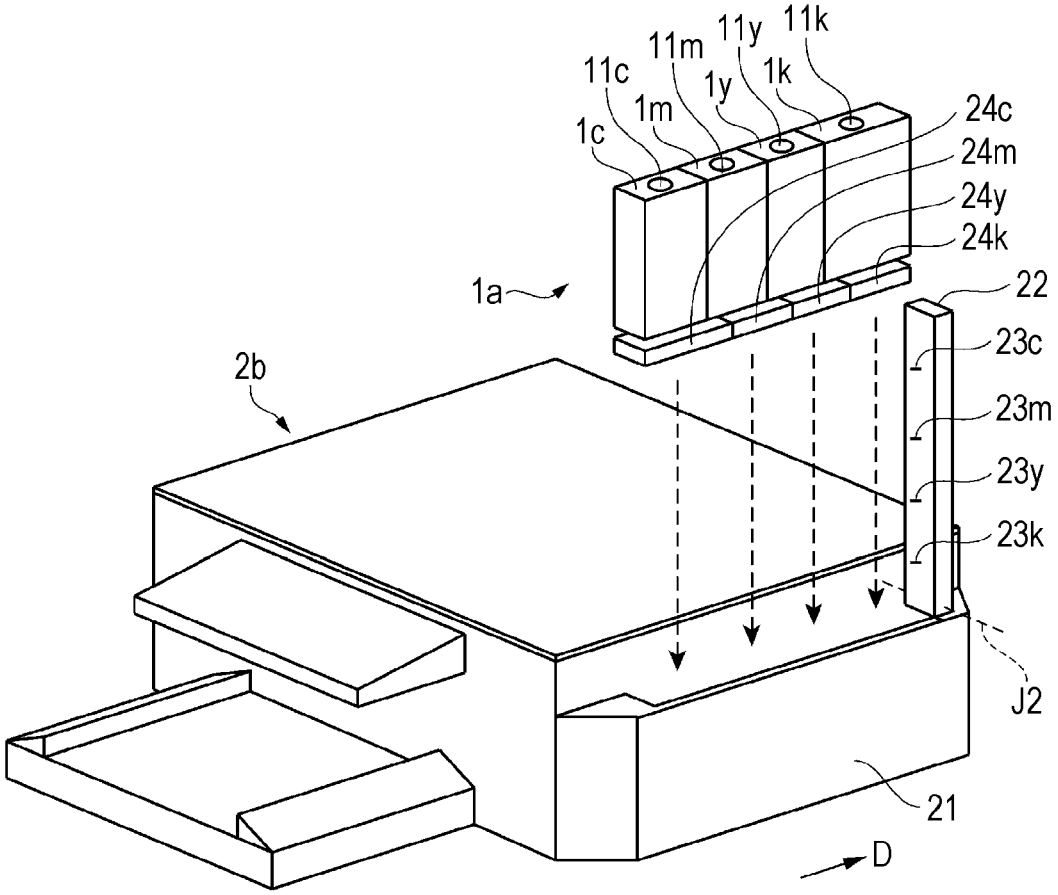
FIG. 5 is an external perspective view of a printer in a state where an ink tank is taken out in still another embodiment.

As illustrated in a printer 2*b* in FIG. 5, in ink tanks 1*c*, 1*m*, 1*y*, and 1*k* arranged in a row in a first direction D, the ink tank 1*k* accommodating monochrome ink which is expected to be frequently replaced more than the other ink tanks may be disposed in the closest position to a pivot shaft J2 in an axial direction intersecting the first direction D. Connectors 24*c*, 24*m*, 24*y*, and 24*k*, and needle tubes 23*c*, 23*m*, 23*y*, and 23*k* are disposed corresponding to the placement of the ink tanks 1*c*, 1*m*, 1*y*, and 1*k*.

According to such a the configuration, in forces which are required for the user to make each of the needle tubes 23 alone penetrate the air port sealing members 11 respectively while pressing the lid 22 in the closing direction, a force which is required to penetrate the air port sealing member 11 of the ink tank 1*k* is the minimum value. Meanwhile, a force which is required when penetrating the air port sealing member 11 of the ink tank that is not used is greater than a force which is required when penetrating the air port sealing member 11 of the ink tank that is used already. In addition, as the principle, the user can penetrate the ink tank disposed in the position closest to the pivot shaft J2 with a small force. Thus, as described above, it is preferable that the ink tank that is expected to be frequently replaced more than the other ink tanks is provided in a position closer to the pivot shaft J2 than the other ink tanks.

What is claimed is:

1. An ink tank comprising:

a reservoir that stores ink;

a supply port that supplies ink stored in the reservoir to a printer;

a supply port sealing member that seals the supply port;

an air port that communicates between an inside of the reservoir and an atmospheric space above an upper side of a liquid surface of the ink; and an air port sealing member which a needle tube is capable of inserting and pulling out of, and which seals the air port in a state where the needle tube is not inserted, wherein the ink tank is accommodated in an accommodating section of the printer, wherein the needle tube is supported by a lid section of the accommodating section.

2. The ink tank according to claim 1, wherein the air port sealing member is formed of an elastic material.

3. The ink tank according to claim 2, further comprising:

an atmosphere passage having a plurality of bending sections, wherein the air port communicates with the reservoir through the atmosphere passage.

4. A printer comprising:

a receiving section that receives supply of ink from a supply port of an ink tank;

an accommodating section that accommodates the ink tank;

a needle tube that is capable of penetrating an air port sealing member sealing an air port of the ink tank above an upper side of a liquid surface of the ink; and a needle support section that supports the needle tube such that the needle tube is capable of inserting and pulling out of the air port sealing member, wherein the needle support section is a lid of the accommodating section.

5. The printer according to claim 4, wherein an atmosphere passage for introducing atmosphere into the ink tank through the needle tube is formed in the needle support section.

6. The printer according to claim 5, wherein the atmosphere passage has a plurality of bending sections.

7. The printer according to claim 5, wherein the accommodating section accommodates the plurality of ink tanks, and wherein the atmosphere passage is separately provided for each ink tank.

8. The printer according to claim 4, wherein the lid is provided to be pivotable by being connected to the accommodating section.

9. The printer according to claim 8, wherein the accommodating section accommodates a plurality of ink tanks in a row in a first direction, and wherein the lid has a pivot shaft of which an axial direction is the first direction and the needle tube is provided on the pivot shaft side from a center position of the lid in a direction intersecting the first direction.

10. The printer according to claim 8, wherein the accommodating section accommodates the plurality of ink tanks in a row in the first direction, and wherein the lid has a pivot shaft of which the axial direction is a direction intersecting the first direction and an ink tank in which monochrome ink is accommodated is disposed in a position closest to the pivot shaft.

11. The printer according to claim 4, wherein the accommodating section accommodates the plurality of ink tanks, and wherein the lid is separately provided for the ink tank.

* * * * *